US007150611B2

(12) United States Patent
Perna

(10) Patent No.: US 7,150,611 B2
(45) Date of Patent: Dec. 19, 2006

(54) EQUIPMENT WITH MUTUALLY INTERACTING SPIRAL TEETH

(76) Inventor: Vratislav Perna, Tučkova 40, 60200 Brno (CZ)

( * ) Notice: Subject to any disclaimer, the term of this patent is extended or adjusted under 35 U.S.C. 154(b) by 417 days.

(21) Appl. No.: 10/204,161

(22) PCT Filed: Feb. 15, 2001

(86) PCT No.: PCT/CZ01/00007

§ 371 (c)(1),
(2), (4) Date: Aug. 19, 2002

(87) PCT Pub. No.: WO01/61151

PCT Pub. Date: Aug. 23, 2001

(65) Prior Publication Data

US 2003/0012675 A1 Jan. 16, 2003

(30) Foreign Application Priority Data

Feb. 18, 2000 (CZ) ..... 581-00

(51) Int. Cl.
*F03C 2/00* (2006.01)
*F04C 18/00* (2006.01)

(52) U.S. Cl. ..... 418/201.1; 418/194

(58) Field of Classification Search ..... 418/194, 418/201.1

See application file for complete search history.

(56) References Cited

U.S. PATENT DOCUMENTS 2,543,894 A * 3/1951 Colombo ..... 425/204
2,908,226 A 10/1959 Rich
5,533,887 A 7/1996 Maruyama et al.

FOREIGN PATENT DOCUMENTS

| | | |
|---|---|---|
| CZ | PV55891 | 3/1991 |
| CZ | 8308 | 11/1998 |
| DE | 19728434 | 1/1999 |
| DE | 19738132 | 9/1999 |
| GB | 419338 | 11/1934 |
| GB | 2030227 | 4/1980 |
| JP | 01267384 A * | 10/1989 |
| WO | WO8706654 | 11/1987 |
| WO | WO9314299 | 7/1993 |

* cited by examiner

*Primary Examiner*—Theresa Trieu
(74) *Attorney, Agent, or Firm*—Ladas & Parry LLP

(57) ABSTRACT

There is designed an equipment with mutually interacting spiral teeth, comprising at least two spiral rotors seating in a stator, where surfaces of the rotor shafts, a rotation wrapper of each of the rotors, each one being furnished with at least one spiral tooth, and a shape of the stator inner further are created by a rotation of a combination of curves having convex and/or concave shape, the curve waveform being defined by shapes of the spiral teeth profiles and their thread lead, provided the spiral teeth profiles and their thread lead, as presented in any section perpendicular to a longitudinal axis of the rotors, are created in relation to required values of pressure, volume and velocity of a media in any part of a working space within the section, the working space being defined as intermediate space between respective spiral rotors themselves and between the rotors and the stator, while the spiral teeth manifest leads of the same or opposite sense.

6 Claims, 12 Drawing Sheets

EQUIPMENT WITH MUTUALLY INTERACTING SPIRAL TEETH

TECHNICAL FIELD

The invention relates to an equipment with mutually interacting spiral teeth, comprising at least two rotors and a stator with a working area determined by at least two spiral teeth, which are wound-up on shaft surfaces, thus creating the rotors, the spiral teeth having the same or opposite sense of thread leads, a constant or variable lead angle and the spiral teeth wrapper is determined by a sum of profiles of all sections through the spiral tooth by a rotation plane intersecting the axis of rotation, while the axes of rotations of mutually interacting spiral teeth are parallel or concurrent or skewed.

BACKGROUND OF THE INVENTION

Basic requirements on equipment with mutually interacting spiral teeth comprise either a change of a medium volume without or with a simultaneous increase of its pressure, or a change of pressure and/or flow rate at the output while maintaining the medium volume or an utilisation of a medium pressure energy without a change of the medium volume and conversion of the energy into a rotary motion or an utilisation of the pressure energy by simultaneous medium expansion and conversion of the energy on a rotary motion or expansion of a burning mixture of fuel and compressed medium volume and conversion of the pressure energy into a rotary motion by a simultaneous medium volume expansion.

There exist a plenty of well-known equipment operating on a principle of mutual interaction of spiral teeth wound-up on at least two rotors seating in a stator, or, as the case may be, wound-up on one rotor and on inner stator surface Spiral teeth surface can be by parts described by functions given in any point by three parameters, i.e. by a diameter of a basic helix, by an angle of an angular displacement and by an angle of a helix lead. Each rotor can be represented by a determined sum of profile sections running through co-axial rotating areas, usually defined as surfaces of second degree, namely a spherical surface, a conical surface and in limited values by a surface perpendicular to the axis of rotation. The solutions known at present have spiral teeth which are wound-up on a cylindrical or a conical shaft wrapper. These solutions are known for different type of profiles of spiral teeth, nevertheless they do not enable a variability and especially steepness of profile changes of the same spiral tooth along its axis. By rotors with a shaft cylindrical wrapper it is possible to change the thread intermediate space only by a change of spiral teeth lead. At rotors with a spiral conical wrapper it is possible to change the thread intermediate spaces by a change of spiral teeth lead and by a change of a vertex angle of the conical shaft wrapper. The change of volume of space between the threads is in both cases limited by the length and by rotors diameters. It is impossible to extremely increase the size of rotors because the demands on built-in space do not increase proportionally. Large masses can cause unbalances and oscillation of rotors and problems with their sealing.

Known equipment for media compressing, like rotational spiral compressors, work on a principle of rotors with cylindrical rotational wrapper and with spiral teeth having a constant lead and a constant teeth profile. These rotors function only by transporting a medium through thread intermediate spaces in the direction from input to output. The pressure is produced at the equipment output. The disadvantage comprise a limitation of a compression rate caused by equipment dimensions and by the construction as described above as well. The efficiency of the present equipment of this type is limited by a constant shape and size of labyrinth of the thread intermediate spaces.

The equipment with a constant volume of a thread intermediate space is also used as generators and in reversed arrangement as motors, e.g. pneumatic motors, hydro-motors, where a pressure medium is fed to an input and moves spiral rotors. The disadvantage comprise again an invariable and steep characteristics of a pressure change performed between the medium input and output.

By a serial arrangement of the equipment there is acquired a staggered increase of compression, while a parallel combination of a larger number of the equipment provides for an increase of the volume compression rate.

In principle as unsuccessful there can be depicted known constructions of internal combustion engines with spiral teeth. The arrangement of such motors has been so far restricted to combinations of two and more mutually interconnected individual equipment, like a compressor and an expander. The disadvantage of these solutions consist mainly in limited possibilities of adaptation of a shape of a working space and arrangement of individual parts of equipment for suction, compression, expansion and exhaustion to a particularly required procedure of an internal combustion process. All known equipment manifest large dimensions. The types with shafts and housing of a cylindrical shape have mainly large overall length and at the types with conical shafts and housing have large diameters. Such parameters negatively influence even a dynamic balancing of rotors.

Known equipment comprise for example a technical solution according to CZ utility model No. 8308, where spiral teeth are wound-up on a conical body and a rotating wrapper of rotors is also a conical one. In this type of equipment a change of a medium volume occurs already in a thread intermediate space, nevertheless process and degree of compression and expansion of a medium is limited by vertex angles of conical rotors. Such an embodiment cannot be modified so as to change a working characteristic of the equipment as required.

There is also known a solution of a combustion motor with a rotating disc as presented in CZ patent application PV 558-91, describing rotating compressor discs with thread surfaces splitting a working space of a rotating working disc. However this thread surfaces are not in a mutual interaction and the rotating compressor discs serve only as rotating slide valves of the working disc and do not transfer a pressure force into a torque. The disadvantages of this solution include a periodic charge cycle and maximum pressure impacts applied on rotating slide valves. The equipment requires perfect sealing. A wear of parts resulting from combined effects of mutually sliding movements and simultaneously acting impact forces will be high and therefore the service life of the equipment probably low.

Another similar solution of a rotating motor, included in a PCT patent application WO 93/14299, is an equipment utilising a rotating disc for splitting a working space of a rotor with a spiral tooth, the rotating disc being fitted with a notch allowing for a passage of the spiral tooth. The rotating disc and spiral tooth create two movable partitions of the working space. Outer convex surface of the working rotor is given by an outer shape of the rotating disc and do not determine working characteristics of the equipment. The rotating disc spiral tooth is not in interaction with any other spiral tooth.

Another known solution, as described in a paper DE 19738132 A1 is based on a principle of counter-rotating rotors with mutually adapted teeth profiles, with cylindrical or tapered rotation wrappers of rotors and with changing lead of spiral teeth of rotors. The compression happens already in the thread intermediate spaces, nevertheless the degree of compression is limited by the equipment dimensions. A transfer of a medium happens by a rotation of the rotors in mutually opposite directions, the medium being compressed only in an intermediate space of these rotors, not in a space between the rotor and the equipment housing. The construction allows only for a certain maximum possible length of the spiral teeth and a certain minimum number of threads of the spiral teeth is necessary to make it work.

Another known solution according to U.S. Pat. No. 5,533,887 has two interacting rotors running in mutually opposite directions. The two rotors seating in a common housing, have tapered shafts on which there are wound-up spiral teeth with a constant lead and rotational wrappers of the spiral teeth form have a shape of cones with an orientation opposite to that of the shafts. These rotation wrappers of the rotors define tapered inner spaces of the housing with which they are also in a mutual interaction. This construction provides for a surface sealing of the rotor spiral teeth against the housing and therefore the spiral teeth have identical lead depending on vertex angles of the tapered shafts and the housing, the angles determining a waveform of working characteristics of the equipment. By the same input parameters it is possible to obtain only corresponding output parameters. Thus an application variability of the equipment is significantly limited.

Another known design according to U.S. Pat. No. 2,908,226 provides only for skewed rotor axis and the same sense of spiral teeth lead and thus for the same sense of rotor rotation and a constant lead. Due to the constant teeth lead the teeth profile can be changed only by a design of the teeth side walls. To allow for a mutual rolling of the teeth, there is applied a recess in the teeth side wall, the recess being positioned in places where the profiles of adjacent teeth would overlap and prevent any rotation. The shape of rotor profiles thus results only from necessary basic mechanical requirements. The said design is a mere spiral conveyor with a compression of transported media.

There is also known a solution described in GB patent 419338. The equipment, a spiral pump or a compressor is furnished with teeth having only trapezoidal profile. Tooth height to width ratio equals approximately one. Rotors may be equipped with spiral teeth with only opposite sense of lead. Rotational wrapper of the rotors is of a cone shape only, or may comprise several cones with different vertex angles and with a staggered transition from one cone to the adjacent one. Therefore the teeth height and lead is changed only linearly. Only the two parameters are changed.

A solution according to GB patent 2 030 227 presents rotational compressor or a motor-generator powered by a pressurised media, the medium being preferably a gas. The design comprise two double spindles consisting of parts arranged into a spiral, the spindles of each pair being mirror-like arranged on a common shaft. The shafts may be only in a parallel arrangement. A rotational wrapper of the spindles has a conical shape and the spiral teeth have opposite lead with respect to the rotor symmetry plane. The equipment provides for a compression of a media from an input at one end towards a centre and expansion from the centre towards output on the other end. Outside diameter of spiral teeth is changed linearly, so the spindles are of a conical type and simultaneously there is changed only the teeth lead. The teeth profile can be adapted to the desired pressure input/output difference, but only a continuous change can be achieved.

A solution according to paper DE 197 28 434, suitable only for applications as a compressor or an air pump, may comprise only rotors with parallel axis and spiral teeth having opposite sense of lead. The construction provides for a change of a diameter and length of spiral teeth according to changing temperature to maintain clearance between rotors and a stator. Respective rotational wrapper of the rotors and stator inside surface are therefore defined only by one parameter, inside temperature.

Known constructions of mechanisms with spiral teeth of the above discussed type have been designed with respect to desired power at the output, mainly pressure or discharged volume as a final constant value. Only one or two dimension parameters have been selected as variables, while other dimensional parameters have become dependent values. Only in a case of possible limit value overrun, resulting from control calculations, there have been performed a correction and subsequent redesign of the mechanism shape. By a limited number of variables it is not possible to select a desired pressure distribution as a control parameter for design of shape and dimensions of the mechanism. None of the existing mechanisms provides for application of distribution of main parameters, namely pressure, volume and temperature, characterising state of a media in any part of a working space of the mechanism, as control functions for design of outside and/or inside shapes and dimensions of the mechanism. All so far known solutions allow for changes of profiles of spiral teeth and for changes of spiral teeth lead only in a restricted range. No particular exact requirements on media parameters like pressure, volume and velocity within inside working space can be applied.

DISCLOSURE AND OBJECT OF THE INVENTION

The foregoing problems are solved by an equipment with mutually interacting spiral teeth, comprising at least two spiral rotors seating in a stator, where at least a part of a rotation wrapper of each of the rotors and corresponding parts of the stator inner surface and the other rotor shaft surface are created by a rotation of a curve having a convex or concave shape, the equipment in accordance with the present invention, featuring surfaces of the rotor shafts, a rotation wrapper of each of the rotors, each one being furnished with at least one spiral tooth, and a shape of the stator inner further which are created by a rotation of a combination of curves having convex and/or concave shape, the curve waveform being defined by shapes of the spiral teeth profiles and their thread lead. The said spiral teeth profiles and their thread lead as presented in any section perpendicular to a longitudinal axis of the rotors are created in dependence upon required values of pressure, volume and velocity of a media in any part of a working space within the section, the working space being defined as intermediate space between respective spiral rotors themselves and between the rotors and the stator, the spiral teeth having leads of the same or opposite sense. Further in accordance with the present invention the axis of shafts of the spiral rotors are located in one plane or alternatively may be mutually skewed. Still further in accordance with the invention the rotation curve in at least in one of its parts may comprise a convex curve, while at least in one of the remaining part it is of a concave type.

On the contrary to existing mechanisms of the kind, the equipment according to the invention is designed with respect to desired values of a media pressure, volume and flowing speed, the said desired values being initial variable control parameters. The relation between co-ordinates of the tridimensional surface of individual parts of the mechanism and the said control parameters can be described by a general multi-parameter function, the solution of which is a multi-parameter set defining all possible and therefore even all optimal mechanical embodiments of the mechanism. The shape of teeth profile and the teeth lead in each cross section, reflecting the variability of three dimensions, define volume distribution in relation to desired pressure distribution and a set of all possible solutions. The final optimal solution of the mechanism in question is selected form the acquired set of solutions in accordance with limiting depending parameters, such as minimum dimensions with respect to material strength and required output performance. The solution according to the invention fully suits to desired values of pressure, volume and velocity of compressed or expanding media in any part of a working space. It is possible only by a simultaneous change of three dimensional parameters, namely diameters of rotors, profile and lead of spiral teeth in any particular part of the working space. In other words the said dimensional parameters are defined for each point of the working space with respect to selected values of media pressure, volume and velocity in that point. The stator inside surface must of course correspond to rotational wrapper of the rotors.

BRIEF DESCRIPTION OF THE DRAWINGS

By way of examples the invention will be now described with reference to the following drawings.

DESCRIPTION OF PREFERRED EMBODIMENTS

Figure 1A:
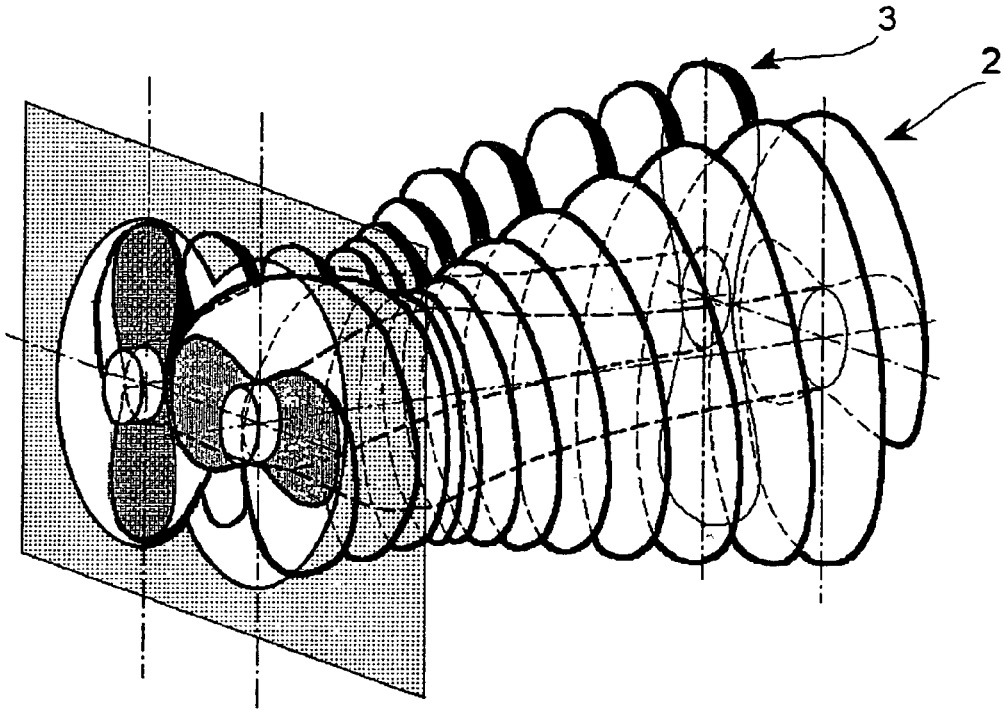
FIG. 1*a* presents two interacting rotors in an axonometric view, showing also a section plane perpendicular to the rotor axis

On FIG. 1*a* there is presented an example embodiment of a part of the equipment according to the invention. The axonometric view shows two mutually interacting rotors 2,3 and a section plane perpendicular to the rotor axis. The section plane of FIG. 1*a*, as presented in a detail on FIG. 1*b*, offers a view on working space between stator and rotors, the working space being depicted by white, non-cross-hatched field within the section.

As further described in details the design according to the invention suits to desired values of pressure, volume and velocity of compressed or expanding media in any part of a working space. The principal dimensional parameters, namely diameters of rotors, profile and lead of spiral teeth are defined for each point of the working space with respect to the said operation parameters. The stator 1 inside surface corresponds to a rotational wrapper of the rotors defined by the above procedure.

For a purpose of a clarity of the description and patent claims the applied basic terms are defined as follows.

A concave curve is such a curve, for all points of which it applies, that the curve at its any section can be expressed by a parameter function, defining a distance of a curve point from the parameter axis, the second derivative of the function to this parameter at this point being always negative or equalling to a zero.

A convex curve is such curve, for all points of which it applies, that the curve at its any section can be expressed by a parameter function, defining a distance of a curve point from the parameter axis, the second derivative of the function to this parameter at this point being always positive or equalling to a zero.

The parameters of a convex or a concave curve, for which a second derivative equals zero applies in the case of the invention only for limit, transit points between adjacent curves.

A contact curve is a set of points at which there occurs a maximum approach or a mutual contact of surfaces of spiral teeth of interacting rotors or contact of surfaces of spiral teeth of interacting rotors with a stator inner wrapper.

A rotation wrapper is a limiting rotation surface defining a space of a rotating body all points of which are always only on one side of this surface and at the same time every point of this surface is a point through which there passes a rotation track of at least one point of the rotating body.

Figure 1B:
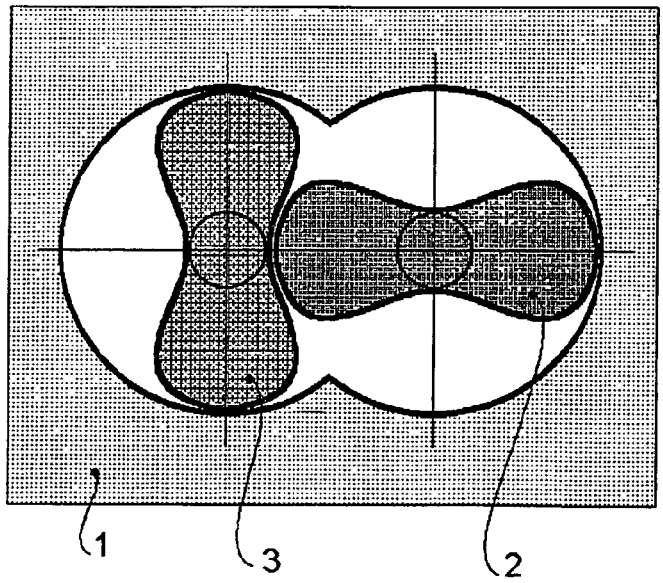
FIG. 1*b* presents the section plane according to FIG. 1*a*, showing working space between stator and rotors
Figure 2A:
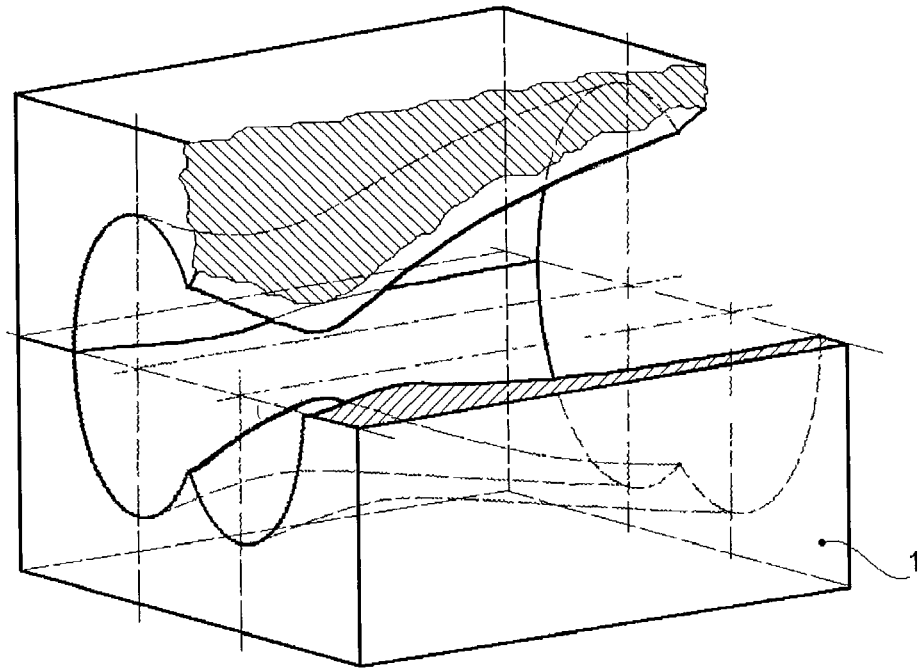
FIG. 2*a* shows an axonometric view of a housing without rotors in a partial section
Figure 2B:
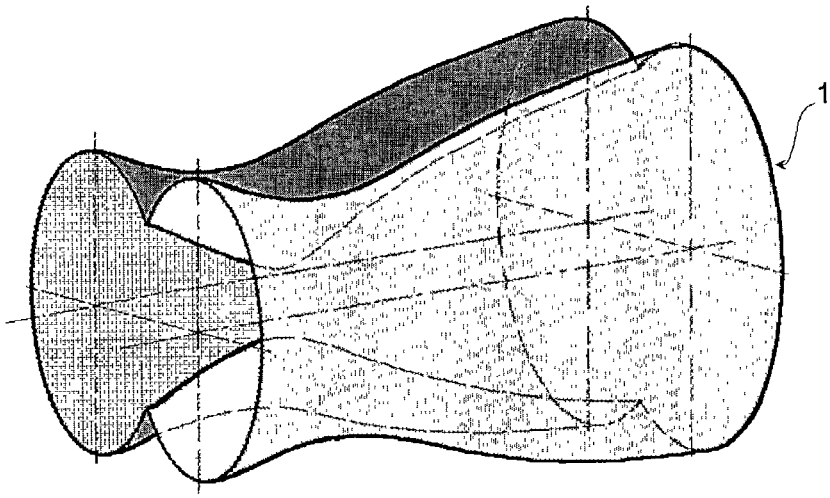
FIG. 2*b* shows an axonometric view of a stator housing, the housing constituting substantially a wrapper of rotors
Figure 2C:
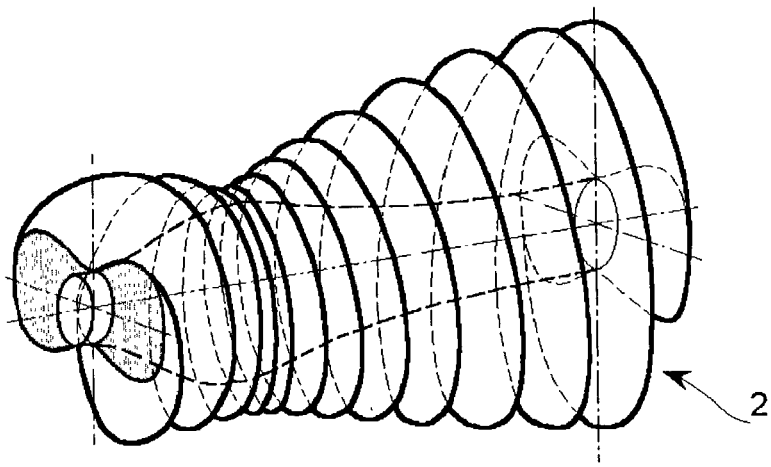
FIG. 2*c* shows an axonometric view of a rotor with two spiral teeth wound on a rotor surface, the rotor combining concave and convex shapes

The arrangement of a double rotor equipment shown of FIGS. 1*a* and 1*b* is in more details illustrated by axonometric views displayed in FIGS. 2*a*, 2*b*, 2*c*. On FIG. 2*a* there is shown a stator 1, representing a housing of the equipment. The stator 1 is designed to accommodate two rotors, the first rotor 2 and the second rotor 3 in parallel arrangement. FIG. 2*b* shows an inner wrapper of the stator 1, the shape of which is identical with the joint wrapper of rotation wrappers of the first rotor 2 and the second rotor 3, which are in an interaction with the inner wrapper of the stator 1. FIG. 2*c* shows a view upon a separate first rotor 2.

Figure 3:
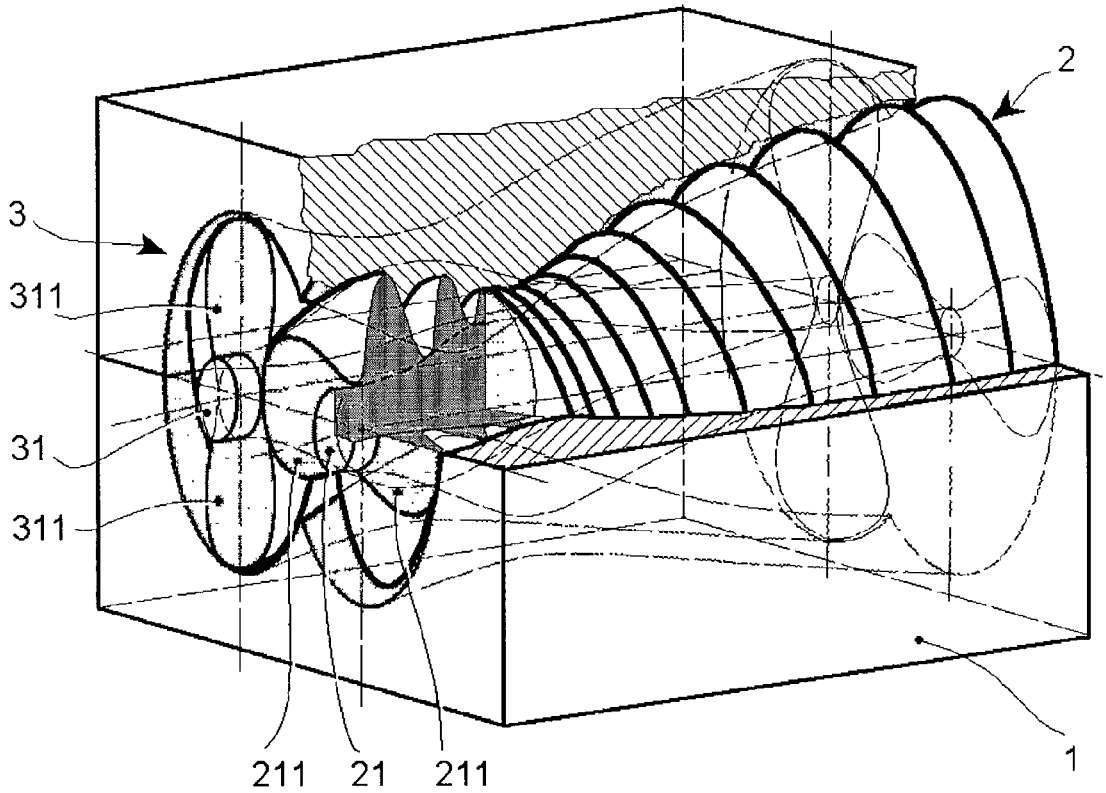
FIG. 3 shows an axonometric view on stator housing furnished with two rotors, one of the rotors being in a partial section through spiral teeth

Another specific embodiment of the technical solution according to the invention is presented on FIG. 3. In a partial sectional view there is shown the stator 1, representing also the equipment housing, which accommodates two rotors. The first rotor 2, consists of a first-rotor shaft 21 with a combined concave and convex surfaces, on which spiral teeth are wound, the first first-rotor tooth 211 and the second first-rotor tooth 211, the teeth being mutually turned by an angle of 180°. The second rotor 3, consists of a second-rotor shaft 31 with a combined concave and convex wrappers, on which spiral teeth are wound, namely the first second-rotor tooth 311 and the second second-rotor tooth 311, both teeth being mutually turned by an angle of 180°. Both rotors 2,3 have parallel axes, identical profiles of the first-rotor teeth 211 and the second-rotor teeth 311 and identical lead, nevertheless the first-rotor teeth 211 have the opposite sense of lead than the second-rotor teeth 311. Both the first-rotor teeth 211 enter into the intermediate space of threads of both second-rotor teeth 311, and therefore the first rotor 2 and the second rotor 3 are in a mutual interaction, engaging especially along contact curves. Rotation tracks of the first-rotor teeth 211 and the second-rotor teeth 311 overlap each other. The first-rotor teeth 211 divide the opposing intermediate spaces of the threads of the second-rotor teeth 311 and in this way they are covering them as partition walls and at the same time also the second-rotor teeth 311 divide the opposing intermediate spaces of the threads of the first-rotor teeth 211, covering them as partition walls. An inner space of the stator 1 is limited by a wrapper of a system of circles; which are at one hand co-axial with the axis of rotation of the first rotor 2 and simultaneously circumscribed to the sum of profiles of all sections through the first-rotor teeth 211 and at the other hand co-axial with the axis of rotation of the second rotor 3 and at the same time circumscribed to the sum of profiles of all sections through the second-rotor teeth 311. As a consequence of the mutual interaction of the first rotor 2, the second rotor 3 and the stator 1, thread intermediate spaces are created between the first-rotor teeth 211, the second-rotor teeth 311 and the stator 1.

The equipment according to the specific embodiment of FIG. 3 operates in such a way, that by counter rotation of the first rotor 2 and the second rotor 3 within the stator 1 the medium entering through an input into the intermediate space of threads of the first rotor 2 and the second rotor 3 is moved towards the output. By mutual interaction of the first rotor 2 and the second rotor 3 there is performed a mutual partition of the first rotor 2 thread intermediate space by the second rotor 2 and vice versa. Due to the combination of a concave and convex shape of the surfaces of the first-rotor shaft 21 and the second-rotor shaft 31, the intermediate space of the threads of the spiral first-rotor teeth 211 and the second-rotor teeth 311 decreases with each subsequent thread and the medium within the thread intermediate space is compressed and subsequently with increasing thread intermediate spaces the medium is expanding.

In an alternative case, the first-rotor teeth 211 may have the same sense of lead as the second-rotor teeth 311 and as a consequence the sense of rotation of both rotors shall be the same. The function of the equipment in this case will be substantially the same. The sense of the thread lead and mutual engagement of the first-rotor teeth 211 and the second-rotor teeth 311 impose limitations on possible shapes of their profiles and thus on choice of a preferred application of the equipment in a praxis.

Figure 4A:
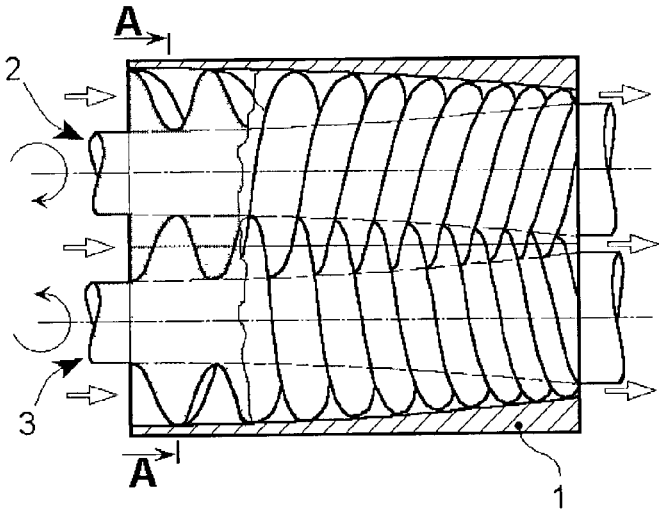
FIG. 4*a* shows in a partial section a pair of rotors with a convex surface and located in a common housing of a compressor application
Figure 4B:
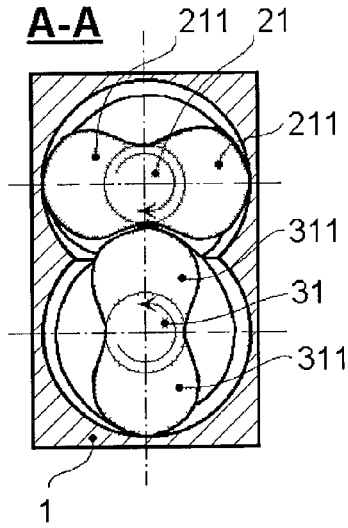
FIG. 4*b* shows a pair of rotors in a partial section along the plane A—A according to FIG. 4*a*, the rotors being located in a common housing

Another particular specific embodiment of the technical solution according to the invention is schematically displayed in a sectional view on FIGS. 4*a*, 4*b*. In the stator 1, which is the housing of the equipment, the first rotor 2 and the second rotor 3. are seated in a push-fit. The first rotor 2 consists of the first-rotor shaft 21 having a surface of a convex shape, at which the first spiral first-rotor tooth 211 and the second spiral first-rotor tooth 211 are wound, both first-rotor teeth being mutually turned by angle of 180°. The second rotor 3 consists of the second-rotor shaft 31 having a surface of a convex shape, at which the first spiral second-rotor tooth 311 and the second spiral second-rotor tooth 311 are wound, both second-rotor teeth being mutually turned by an angle of 180°. The first rotor 2 and the second rotor 3 have mutually parallel axes, and both the spiral first-rotor teeth 211 and the second-rotor teeth 311 have identical profiles and decreasing lead angle, nevertheless the first-rotor teeth 211 have the opposite lead sense than the second-rotor teeth 311. Both the first-rotor teeth 211 inter into the intermediate spaces of threads of both second-rotor teeth 311, so that the first rotor 2 and the second rotor 3 are in a mutual interaction, engaging substantially along contact curves. Rotation tracks of the first-rotor teeth 211 and the second-rotor teeth 311 overlap each other, as displayed by the section A—A of FIG. 4*b* The first-rotor teeth 211 divide opposing intermediate spaces of the threads of the second-rotor teeth 311 thus covering them as partition walls. Simultaneously the second-rotor teeth 311 divide opposing intermediate spaces of the threads of the first-rotor teeth 211, thus also covering them as partition walls. The inner space of the stator 1 is limited by a rotation wrapper of the first rotor 2 and at the same time by a rotation wrapper of the second rotor 3. In this particular embodiment the inlet is on the side of the maximum mutual overlapping of the first rotor 2 and the second rotor 3, while the equipment outlet is on the opposite side, manifesting minimal mutual overlapping of both rotors 2, 3. FIG. 4*b* displays the first rotor 2 and the second rotor 3 with preferred profiles of the spiral first-rotor teeth 211 and the second-rotor teeth 311, both engaging rotors being shown as viewed in a plane perpendicular to the axes of rotation of the rotors 2, 3.

The equipment according to the specific embodiment of FIGS. 4*a* and 4*b* operates in such a way, that by counter rotation of the first rotor 2 and the second rotor 3 within the stator 1 the medium entering through an input into the intermediate space of threads of the first rotor 2 and the second rotor 3 is moved towards the output. By mutual interaction of the first rotor 2 and the second rotor 3 there is performed a mutual partition of the first rotor 2 thread intermediate space by the second rotor 2 and vice versa. Due to the convex shape of the surfaces of the first-rotor shaft 21 and the second-rotor shaft 31, the intermediate space of the threads of the first-rotor teeth 211 and the second-rotor teeth 311 decreases with each subsequent thread and the medium within the thread intermediate space is compressed.

Figure 4C:
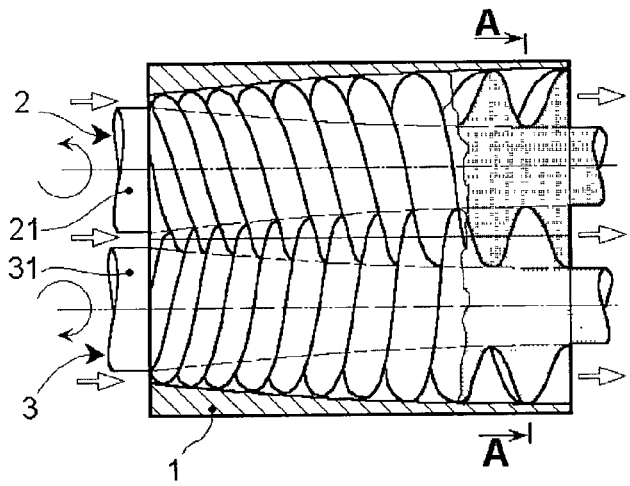
FIG. 4*c* shows a pair of rotors with a convex surface in a partial sectional view, the rotors being located in a common housing. The direction of the rotor motion and the direction of a media flow are opposite to the situation illustrated in FIGS. 3*a*, 4*b*, thus providing for an expander application of the equipment

The equipment according to the specific embodiment of FIG. 4*c* has the same arrangement as the embodiment according to FIGS. 4*a*, 4*b*, only the first rotor 2 rotates in a direction opposite and the sense of rotation of the second rotor 3. The medium inlet is on the side of the equipment with the minimum mutual overlapping of the first rotor 2 and the second rotor 3 and the equipment outlet of is on the opposite side, manifesting maximum mutual overlapping of the first and second rotors 2, 3. As a consequence of the convex shape of the surfaces of both the first-rotor shaft 21 and the second-rotor shaft 31, the thread intermediate spaces of the first rotor 2 and the second rotor 3 increase with each subsequent thread and the medium within the thread intermediate spaces is expanding. This allows for an expansion function of this specific embodiment of the equipment.

Figure 5A:
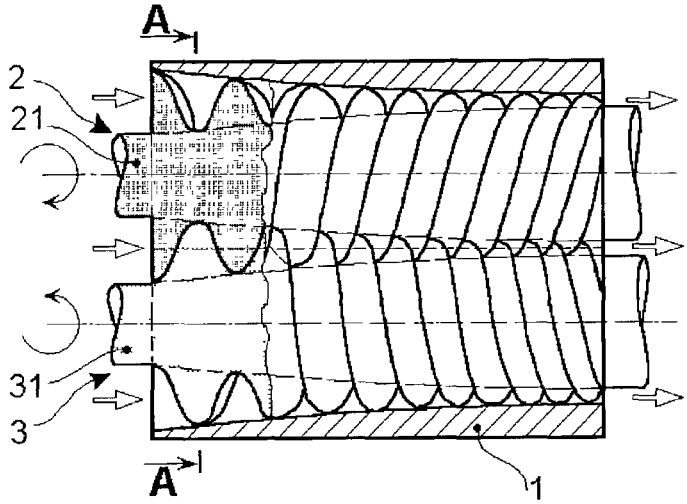
FIG. 5*a* shows a pair of rotors with a concave surface in a partial sectional view, the rotors being located in a common housing of a compressor application.
Figure 5B:
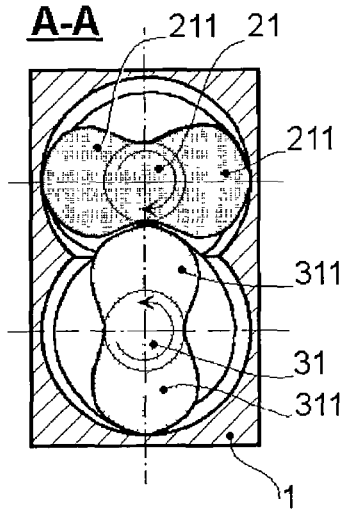
FIG. 5*b* shows a pair of rotors in a partial section along the plane A—A according FIG. 4*a*, the rotors being located in a common housing

Another particular specific embodiment of the technical solution according to the invention is schematically displayed in a sectional view on FIGS. 5*a*, 5*b*, the latter one showing a sectional view A—A according to FIG. 5*a*. In the stator 1, which is the housing of the equipment, there are in a push fit seated the first rotor 2 and the second rotor 3. The first rotor 2 consists of the first-rotor shaft 21 having a surface of a concave shape, at which the first spiral first-rotor tooth 211 and the second spiral first-rotor tooth 211 are wound, both first-rotor teeth 211 being mutually turned by an angle of 180°. The second rotor 3 consists of the second-rotor shaft 31 having a surface of a concave shape, at which the first spiral second-rotor tooth 311 and the second spiral second-rotor tooth 311 are wound, both second-rotor teeth 311 being mutually turned by an angle of 180°. The first rotor 2 and the second rotor 3 have axes arranged in parallel, and both the spiral first-rotor teeth 211 and the second-rotor teeth 311 have identical profiles and decreasing lead angle, but the spiral first-rotor teeth 211 have the opposite lead sense than the spiral second-rotor teeth 311. Both first-rotor teeth 211 inter into the intermediate spaces of threads of both spiral second-rotor teeth 311, so that the first rotor 2 and the second rotor 3 are in a mutual interaction, engaging substantially along contact curves. Rotation tracks of the spiral first-rotor teeth 211 and the second-rotor teeth 311 overlap each other, as displayed on the section A—A of FIG. 5*b* The first-rotor teeth 211 divide opposing intermediate spaces of the threads of the second-rotor teeth 311 thus covering them as partition walls. Simultaneously also the second-rotor teeth 311 divide opposing intermediate spaces of the threads of the first-rotor teeth 211, thus also covering them as partition walls. The inner space of the stator 1 is limited by a rotation wrapper of the first rotor 2 and at the same time by a rotation wrapper of the second rotor 3. In this particular embodiment the inlet is on the side of the maximum mutual overlapping of the first rotor 2 and the second rotor 3, while the equipment outlet is on the opposite side, manifesting minimum mutual overlapping of both rotors 2, 3. FIG. 5*b* displays the first rotor 2 and the second rotor 3 with preferred profiles of the first-rotor teeth 211 and the second-rotor teeth 311, both engaging rotors being shown as viewed in a plane perpendicular to the axes of the rotor rotation. From the point of view of function the embodiment of FIGS. 5*a* and 5*b* offers a working characteristics of a media compression having a steeper waveform than applies for the embodiment of FIGS. 4*a*, 4*b*.

Figure 5C:
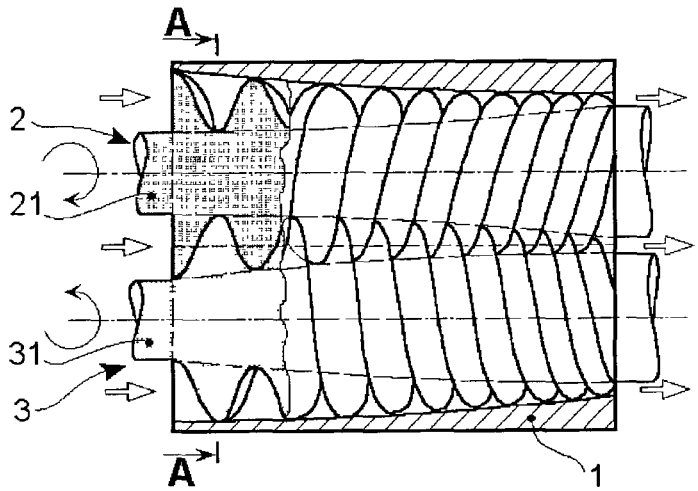
FIG. 5*c* shows a pair of rotors located in a common housing, in a partial sectional view, one of the rotors having convex surface and the other one a concave surface, the arrangement being designed for an application as a compressor.
Figure 5D:
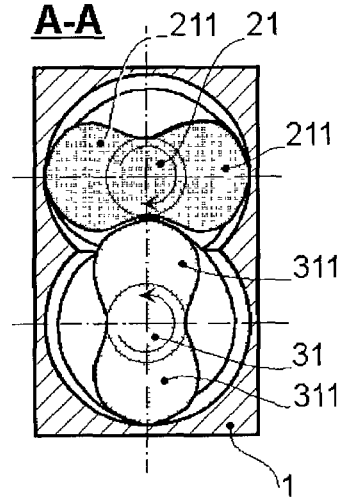
FIG. 5*d* shows a pair of rotors in a common housing, in a section along the plane A—A according to FIG. 5*c*

Another particular specific embodiment of the technical solution according to the invention as schematically displayed in a sectional view on FIGS. 5*c* and 5*d*, is equivalent to the embodiment of FIGS. 5*a* and 5*b*. It differentiates from the previous one by the shape of shaft surfaces as the first-rotor shaft 21 surface has a convex shape while the second-rotor shaft 31 surface is concave. This shapes result in rather different shapes of the first rotor 2 and the second rotor 3 and their rotation wrappers, defining an inner space of the stator 1. Other parameters, arrangement and mutual interactions of elements of the specific embodiment displayed at FIGS. 5*c*, 5*d* correspond to the embodiment of FIGS. 5*a*, 5*b*. Its function is analogous to the previous specific embodiments of FIGS. 4*a*, 4*b* and 5*a*, 5*b*. The difference is to be seen in the fact that the equipment according to this specific embodiment, combining the first-rotor shaft 21 with a concave surface and the second-rotor shaft 31 with a convex surface within the stator 1, has unequal thread intermediate spaces of the first-rotor teeth 211 and the second-rotor teeth 311, the difference resulting from the different rotor rotation wrappers. As a consequence of this arrangement a change of the thread intermediate space has steeper characteristic than it is by the equipment with the first-rotor shaft 21 and the second-rotor shaft 31 having convex surfaces, as displayed on FIGS. 4*a*, 4*b*, but not such a steep characteristic as the equipment with the first-rotor shaft 21 and the second-rotor shaft 31 having concave surfaces, as displayed on FIGS. 5*a*, 5*b*. This applies only when provided that profiles, lead and numbers of spiral teeth are substantially identical.

Figure 5E:
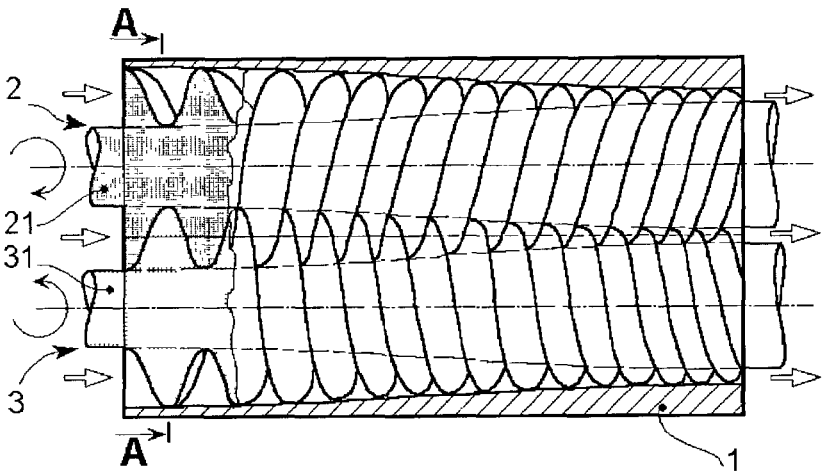
FIG. 5*e* shows a pair of rotors located in a common housing, in a partial sectional view, the rotors shafts having partially convex and partially concave surfaces, the said arrangement being designed for a compressor application
Figure 5F:
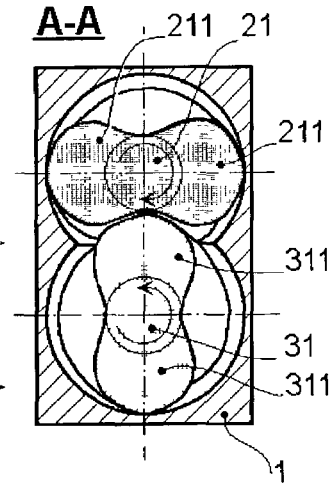
FIG. 5*f* shows a pair of rotors located in a common housing in a section along the plane A—A according to FIG. 5*e*

Another particular specific embodiment of the technical solution according to the invention as schematically displayed in a sectional view on FIGS. 5*e*, 5*f*, is equivalent to the embodiment of FIGS. 5*a* and 5*b*. It differentiates from the previous one by the shape of shaft surfaces as both the first-rotor shaft 21 surface and the second-rotor shaft 31 surface have partially convex and partially concave shape, both surfaces being mutually identical. This shapes result in rather different shapes of the first rotor 2 and the second rotor 3 and their rotation wrappers, defining an inner space of the stator 1. Other parameters, arrangement and mutual interactions of elements of the specific embodiment displayed on FIGS. 5*e*, 5*f* correspond to the embodiment of FIGS. 5*a*, 5*b*. This embodiment combines features of the solution according FIGS. 4*a* and 4*b*, with features of the embodiment according FIGS. 5*a*, 5*b* and allows for more favourable waveform of the operation characteristic of media compression. In the inlet part of the equipment, within thread intermediate spaces, due to the high profile of spiral teeth of both the first and second rotors 2, 3, there is transported high, constant volume of the medium. In the middle part the medium is continuously compressed and in the outlet part, due to the higher number of teeth with a low profile of the spiral teeth, a closure of an outlet opening is improved, and a return flow of the medium within the equipment is prevented.

A change of a shape of the convex or concave wrappers of the first-rotor shaft 21 and the second-rotor shaft 31 and/or a change of lead of the first-rotor teeth 211 and the second-rotor teeth 311, results in a decrease and/or increase of the volume of intermediate spaces of threads of the first rotor 2 and the second rotor 3. This applies for any part of the first rotor 2 and the second rotor 3.

Figure 6A:
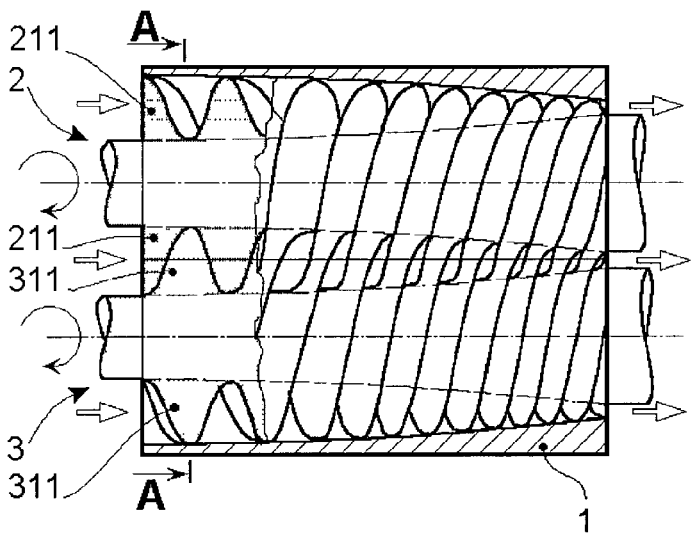
FIG. 6*a* shows a pair of rotors running in the same direction of motion, in a partial sectional view, the rotor shafts having a concave surface and the rotors being located in a common housing of a compressor application
Figure 6B:
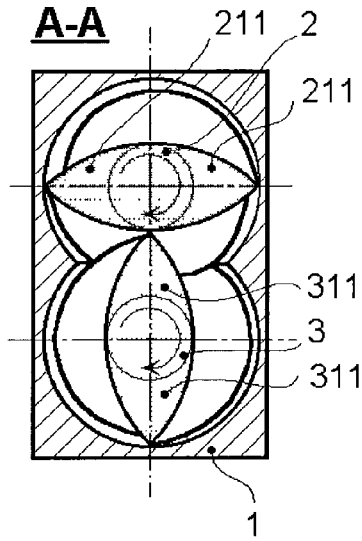
FIG. 6*b* shows a pair of rotors in a partial section along the line A—A according to FIG. 6*a*, the rotors being located in a common housing

Other particular embodiment of the technical solution according to the invention is displayed at FIGS. 6*a*, 6*b*. The spiral first-rotor teeth 211 have the same sense of lead as the spiral second-rotor teeth 311. As a consequence, the sense of rotation of both rotors 2, 3 is the same. The sense of lead and the mutual engagement of the first-rotor teeth 211 and the second-rotor teeth 311, are limiting factors for available shapes of profiles of the spiral first-rotor teeth 211 and the second-rotor teeth 311, as displayed at FIG. 6*b* and thus also for a particular application the equipment function. The equipment function is substantially the same as applies for the equipment of FIGS. 4*a*, 4*b*, but different profiles of the spiral rotating teeth allow for a different waveform of working characteristics of the equipment and different practical application. By opposite sense of rotation of both the first rotor 2 and the second rotor 3, the equipment will work as an expander.

Figure 6C:
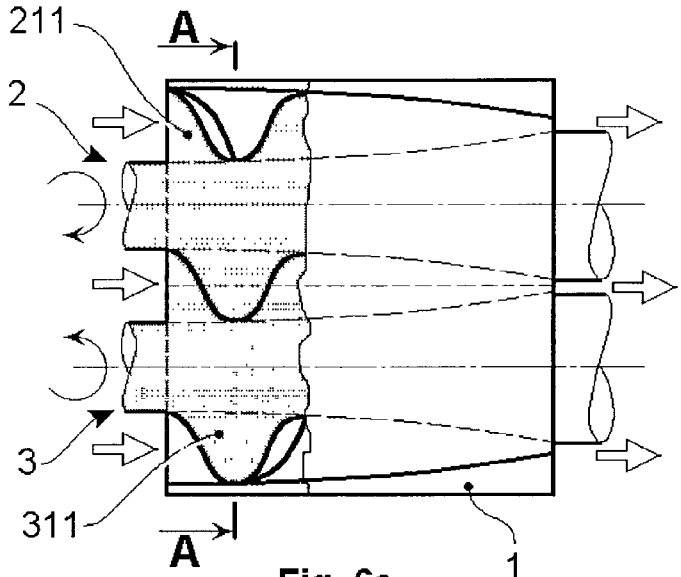
FIG. 6*c* shows a pair of rotors running in an opposite direction of motion, in a partial sectional view, the rotor shafts having one spiral tooth
Figure 6D:
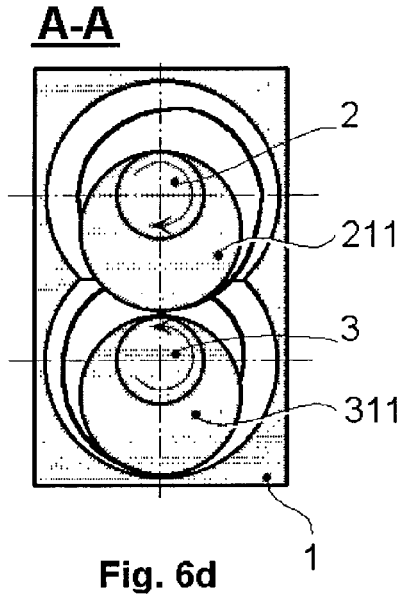
FIG. 6*d* shows a pair of rotors located in a common housing in a section along the plane A—A according to FIG. 6*c*, the tooth profile being illustrated

Another particular solution is the embodiment displayed on FIGS. 6*c*, 6*d* having a first rotor 2 with one spiral first-rotor tooth 211 wound on the first-rotor shaft 21 and a second rotor 3 with one spiral second-rotor tooth 311 wound on a second-rotor shaft 31. This embodiment allows for a choice from a wider variety of profiles of the spiral first-rotor tooth 211 and the second-rotor tooth 311 and for further alternative process of the medium compression in thread intermediate spaces. According to the sense of rotation of both rotors 2, 3 the equipment operates either as a compressor or as an expander.

Another alternative solution is an equipment having the first rotor 2 with one spiral first-rotor tooth 211 wound on a first-rotor shaft 21 and further having a second rotor 3 with several spiral second-rotor teeth 311 wound on a second-rotor shaft 31. This embodiment limits the profile spectrum of spiral rotors teeth and the equipment function is subjected to unequal revolutions of the first rotor 2 and the second rotor 3, which could be favourable for special procedures of medium compression. The first rotor 2 with one first-rotor tooth 211 can for example function as a partition wall, like a spiral slide valve and the second rotor 3 with several spiral second-rotor teeth 311 does the working function, or the other way round.

All the above presented particular solutions and alternatives could be modified by different diameters of the rotation wrappers of rotors. This can advantageously allow for different mode of operation of the equipment according to the invention.

Figure 4D:
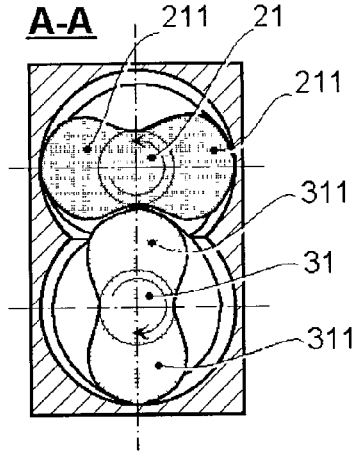
FIG. 4*d* shows a pair of rotors in a sectional view along the plane A—A according to FIG. 4*c*, the rotors being located in a common housing

Each of the mentioned specific embodiments can be also operated in a reverse mode, with reversed direction of rotation of the rotors. In cases when the thread intermediate space moves from an inlet to an outlet, its volume increasing simultaneously, as is the case of the embodiment according to FIGS. 4*c*, 4*d*, the equipment functions as an expander. Such a function may be utilised for a transfer of the medium power in a rotation movement of rotors. Another application is suitable for an equipment utilising a decrease of pressure acting upon a medium during pumping process, e.g. in a case when media must not be pumped under pressure.

Figure 7B:
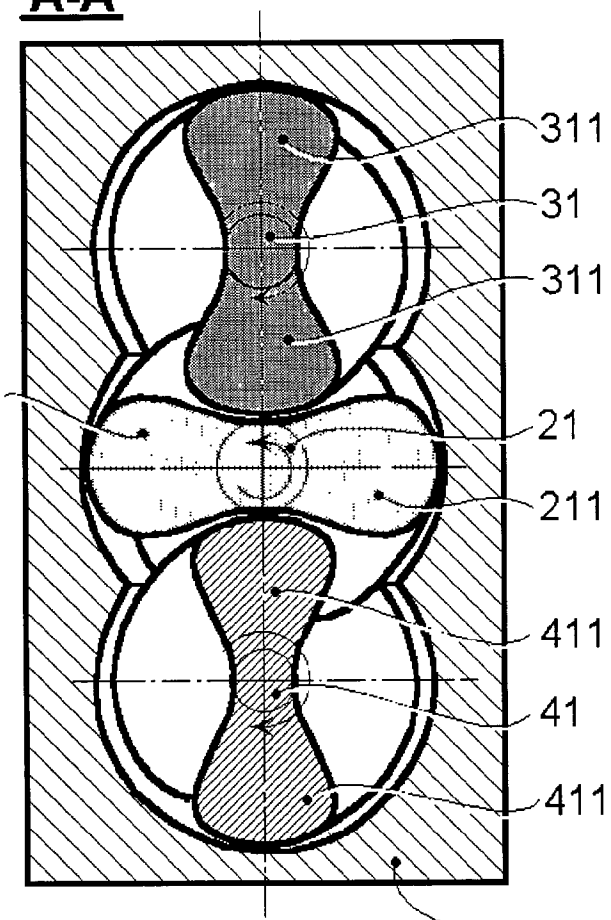
FIG. 7*b* shows the three rotors located in a common housing in a section along the plane A—A according to FIG. 7*b*
Figure 7A:
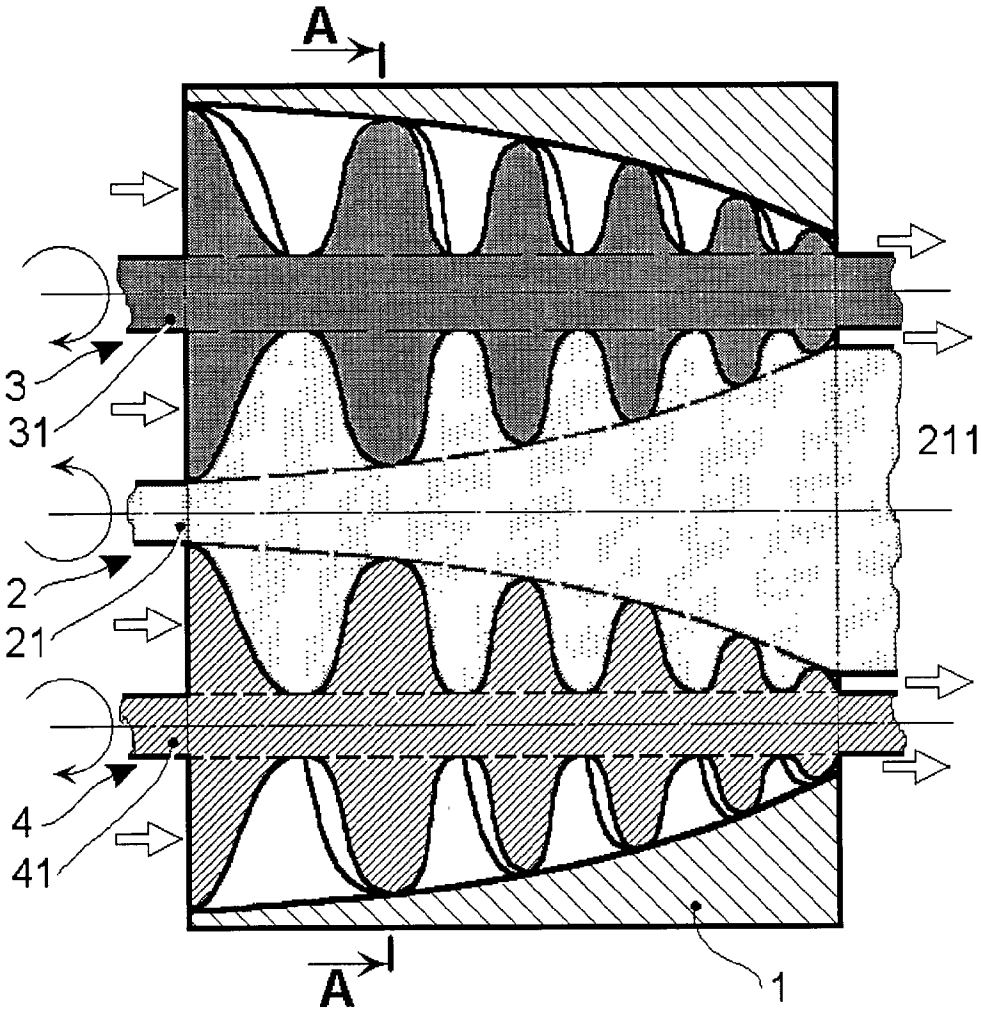
FIG. 7*a* shows an equipment with three rotors in a common housing, the middle rotor having a shaft with a convex surface, both side rotors having cylindrical shafts

Another preferred specific embodiment is displayed in a sectional views on FIGS. 7*a* and 7*b*. In the stator 1 there are seated the first rotor 2, the second rotor 3 and a fourth rotor 4, all rotors 2,3,4 being in a mutual interaction. The first rotor 2 comprise a first-rotor shaft 21 having a surface of a convex shape, at which two spiral first-rotor teeth 211 are wound, both first-rotor teeth 211 being mutually turned by an angle of 180°. The second rotor 3 consists of a second-rotor shaft 31 having a surface of a cylindrical shape, at which two spiral second-rotor teeth 311 are wound, both second-rotor teeth 311 being mutually turned by an angle of 180°. The third rotor 4 has a third-rotor shaft 41 with a surface of a cylindrical shape, at which two spiral third-rotor teeth 411 are wound, both third-rotor teeth 411 being mutually turned by an angle of 180°. Axes of all three rotors 2, 3, 4 are arranged in parallel and in the same plane. The first rotor 2 is located between the third rotor 3 and the fourth rotor 4 and has its spiral first-rotor teeth 211 wound with the opposite sense than both the third rotor 3 and the fourth rotor 4 and profiles of his first-rotor teeth 211 define not only the second-rotor teeth 311 and the third-rotor teeth 411 but also a shape of the stator 1 inner surface. Both the second rotor 3 and the third rotor 4 are identical. They have identical profiles of all their second-rotor teeth 311 and the third-rotor teeth 411, the said teeth 311,411 having also identical sense of lead and lead angles, the angle decreasing in the direction from inlet to outlet of the equipment. The inlet side of the equipment is the side with the smallest diameter of the convex wrapper of the first-rotor shaft 21, while the outlet side manifests the same diameter being the largest one. The first-rotor teeth 211 enter the intermediate spaces of threads of both the second-rotor teeth 311 and third-rotor teeth 411, in an interaction with them, the said mutual engagement being performed substantially along contact curves. Rotation tracks of the spiral first-rotor teeth 11 and the second-rotor teeth 311 overlap each other and the same applies for the first-rotor teeth 211 and the third-rotor teeth 411, as shown on FIG. 7*a*. The first-rotor teeth 211 divide opposing intermediate spaces of the threads of both the second-rotor teeth 311 thus covering them as partition walls. Simultaneously the second-rotor teeth 311 and the third-rotor teeth 411 divide opposing intermediate spaces of the threads of the first-rotor teeth 211, thus also covering them as partition walls. The inner space of the stator 1 is defined by rotation wrappers of all three rotors 2, 3, 4. FIG. 7*b* illustrates mutual interaction of the three rotors 2, 3, 4 with the first-rotor teeth 211, the second-rotor teeth 311 and the third-rotor teeth 411, as seen in a sectional plane perpendicular to axes of rotation of the said rotors2, 3, 4, the said teeth 211, 311, 411 having preferred profiles.

The equipment according to the specific embodiment of FIGS. 7*a* and 7*b* operates in such a way, that by counter rotation of the first rotor 2 with respect to the second rotor 3 and the third rotor 4 a medium entering through an input into the intermediate space of threads of all three rotors 2, 3, 4 is moved towards the output. By mutual interaction of the three rotors 2, 3, 4 there is performed a mutual partition of the first rotor 2 thread intermediate space by the second rotor 3 and vice versa and simultaneously there occurs a mutual partition of the first rotor 2 thread intermediate space by the third rotor 4 and vice versa. Due to the convex shape of the surfaces of the first-rotor shaft 21, the thread intermediate decreases with each subsequent thread and the medium within the thread intermediate spaces is compressed. In this embodiment the equipment operates as a compressor. In an alternative case, with a sense of rotation of the rotors 2, 3, 4 being opposite to the one described above, the equipment shall operate as an expander.

In all the specific embodiments of the equipment designed for operation either as a compressor or as an expander, the stator may be alternatively furnished with rotors having concurrent axes. This arrangement shall result in a steeper waveform of operation characteristics of such an equipment.

Figure 8A:
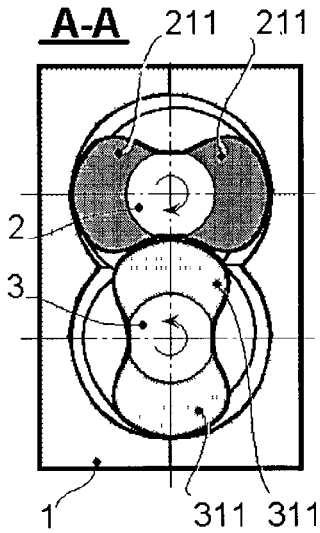
FIG. 8*a* shows a pair of rotors located in a common housing in a section along the plane A—A according to FIG. 8*d*
Figure 8B:
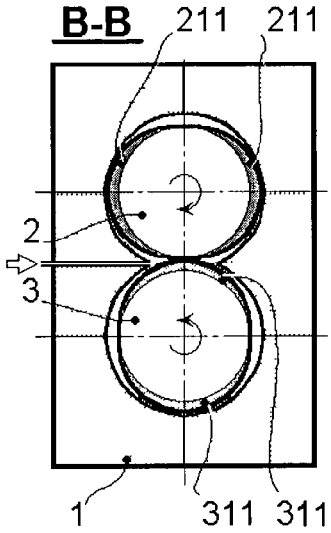
FIG. 8*b* shows a pair of rotors located in a common housing in a section along the plane B—B according to FIG. 8*d*, the tooth profile and a shape of a working space being illustrated
Figure 8C:
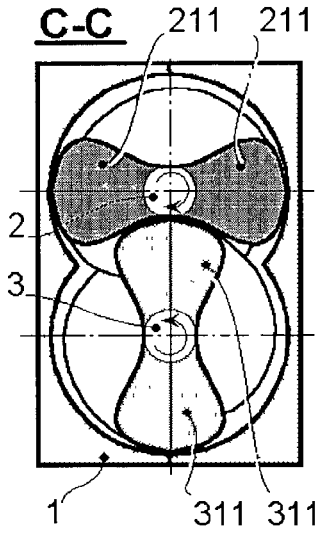
FIG. 8*c* shows a pair of rotors located in a common housing in a section along the plane C—C according to FIG. 8*d*, the tooth profile and a shape of a working space being illustrated
Figure 8D:
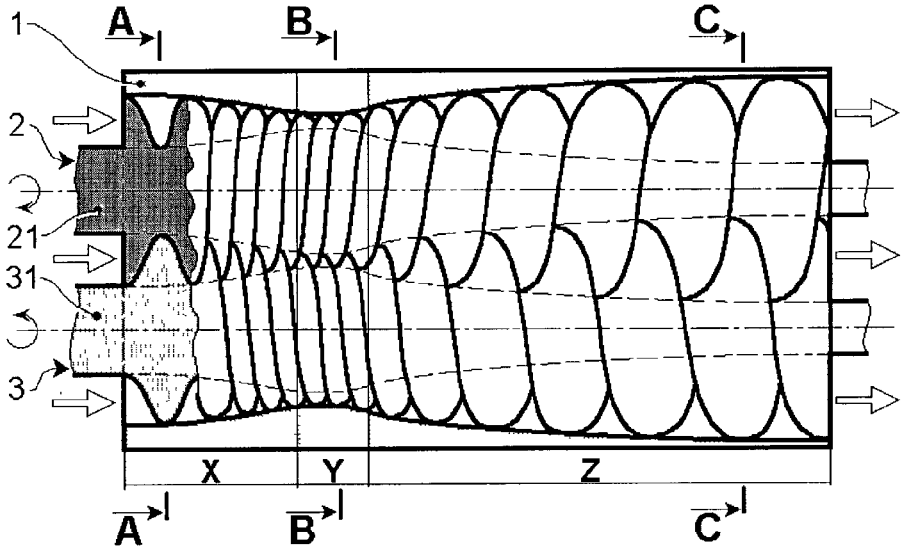
FIG. 8*d* shows a pair of rotors running in an opposite direction of motion, in a partial sectional view, the rotors being located in a common housing and the rotor shafts being partially convex and partially concave and having two spiral teeth FIG. 8*e* graphically illustrates a waveform of pressure (P) and volume (V) within the thread intermediate space according to FIG. 8*d*, the parts "X", "Y" and "Z" being a compression, injection—combustion and expansion sections respectively
Figure 8E:
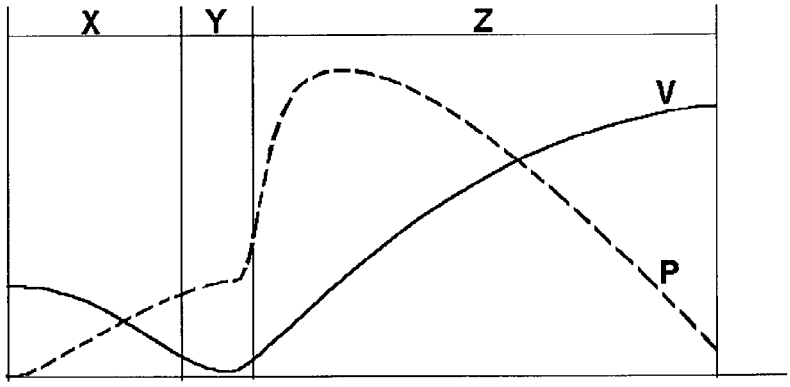

Another preferred specific embodiment is displayed on FIGS. 8*a*, 8*b*, 8*c*, 8*d*. FIG. 8*e* shows waveforms of pressure and volume in thread intermediate space relating to this embodiment. In the stator 1, which representing also a housing of the equipment, the are seated the first rotor 2 and the second rotor 3. The first rotor 2 comprises the first-rotor shaft 21, the surface of which within sections X and Z, as seen on FIG. 8*d*, has a convex shape, while within a section Y it has a concave shape. On the first-rotor shaft 21 two spiral first-rotor teeth 211 are wound, both first-rotor teeth 211 being mutually turned by an angle of 180°. The second rotor 3 consists of a second-rotor shaft 31, the surface of which within the sections X and Z, see FIG. 8*d*, has a convex shape, while within the section Y it has a concave shape. On this surface two spiral second-rotor teeth 311 are wound, both second-rotor teeth 311 being mutually turned by an angle of 180°. Both rotors 2, 3, have parallel axes and substantially identical profiles of all the first-rotor and second-rotor teeth 211, 311. The teeth 211, 311 lead angle is decreasing within the section X, while remaining constant within the section Y and increasing within the section Y. Diameter of a rotation wrapper of the first rotor 2 and the second rotor, 3, is increasing within the section X in the direction inwards from the inlet, while having substantially minimum value within the section Y and increasing within the section Z along the direction towards the outlet, where it reaches its maximum value. The first-rotor teeth 211 have lead with a sense opposite to the one of the second-rotor teeth 311. Both first-rotor teeth 211 enter into the intermediate spaces of threads of both second-rotor teeth 311, providing for an interaction of both rotors 2,3, their mutual engagement being performed substantially along contact curves. Rotation tracks of the spiral first-rotor teeth 211 and the second-rotor teeth 311 overlap each. The spiral first-rotor teeth 211 divide opposing intermediate spaces of the threads of the second-rotor teeth 311 thus covering them as partition walls. Simultaneously the second-rotor teeth 311 divide opposing intermediate spaces of the threads of the first-rotor teeth 211, thus also covering them as partition walls. The inner space of the stator 1 is limited by rotation wrappers of both rotors 2, 3. In this embodiment the equipment may work as an internal combustion engine. A medium enters through inlet in the section X, which operates as a compression chamber of the engine. The section Y operates as an injection and ignition area and the section Z represents an expansion space of the motor completed with the outlet.

The combustion engine according to the specific embodiment of FIGS. 8*a*, 8*b*, 8*c*, 8*d* operates in such a way, that by a counter rotation of the first rotor 2 and the second rotor 3 within the stator 1 air is sucked through an input and moved into the intermediate space of threads of the first-rotor teeth 211 and the second-rotor teeth 311. In the X section, due to the convex shape of surfaces of both the first-rotor shaft 21 and the second-rotor shaft 31 and the respective shape of the stator 1 inside surface the air is compressed. Within the Y section fuel is injected into the compressed air and ignited. Throughout the Z section the burning fuel expands and its pressure energy acts within thread intermediate spaces of the rotors 2,3 upon surfaces of the first-rotor teeth 211 and the second-rotor teeth 311 and the action results in a torque of the rotors 2,3. The outlet is the motor exhaust.

On FIG. 8*e* a curve depicted as "V-curve" represents changes of volume, while the other curve, the "P-curve", represents changes of pressure within the individual sections "X", "Y", "Z" of the motor.

In an alternative case of the combustion engine, the first-rotor teeth 211 may have the same sense of lead as the spiral second-rotor teeth 311 and in consequence of this both rotors 2,3 must the same sense of rotation. The function of such combustion engine is substantially the same. The lead sense and mutual engagement of the first-rotor teeth 211 and the second-rotor teeth 311 is a limiting factor for shapes of profiles of the spiral teeth 211, 311 and therefor also for practical applications of such a combustion engine.

In further alternative embodiments of the combustion engine, the convex surfaces of first-rotor shaft 21 and second-rotor shaft 31 in section X,Z may be changed into a concave one while the surface of the shafts 21, 31 within the section Y has a convex shape. The surface of the shafts 21, 31 may even be of a cylindrical or a tapered shape.

Figure 9A:
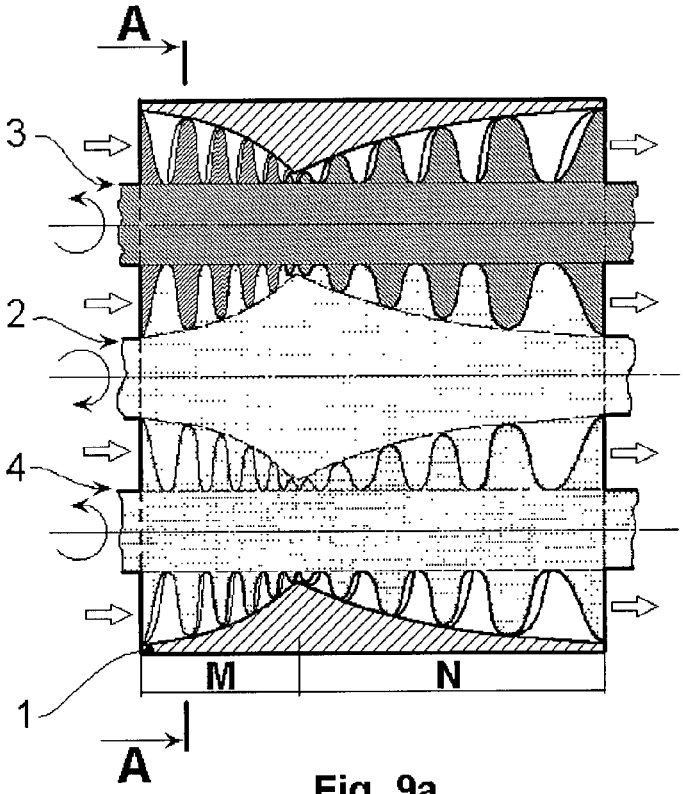
FIG. 9*a* shows an equipment with three rotors in a common housing, the middle rotor having a shaft with a partially convex and partially concave surfaces and both side rotors cylindrical shafts, the equipment being designed for a motor application
Figure 9B:
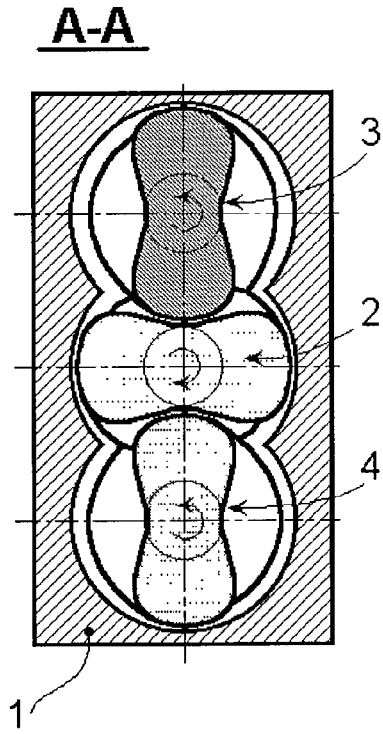
FIG. 9*b* shows three rotors located in a common housing in a sectional view along the plane B—B according to FIG. 9*a*

Still further specific embodiment of the equipment according to the invention is schematically shown on FIGS. 9*a* and 9*b*. In stator 1 there are seated three rotors, a first rotor 2, a second rotor 3 and a third rotor 4, all three rotors being in a mutual interaction, their axes being located in one and the same plane. The arrangement of the rotors 2, 3, 4 correspond substantially to the embodiment shown on FIGS. 7*a*, 7*b*. A part of the equipment, which on FIG. 9*a* is depicted as an "M-section", corresponds to the construction of FIG. 7*a*, designed for compressor application. The adjacent part of the equipment following the "M-section", on FIG. 9 depicted as an "N-section", corresponds to the construction of FIG. 7*a*, but in an alternative, expander application.

The function is similar to the one applying for the specific embodiment of FIGS. 8*a*, 8*b*, 8*c*, 8*d*. The equipment therefore operates also as a combustion engine. The injection and ignition area corresponds to the area of transition of the "M-section" into the "N-section".

Figure 10A:
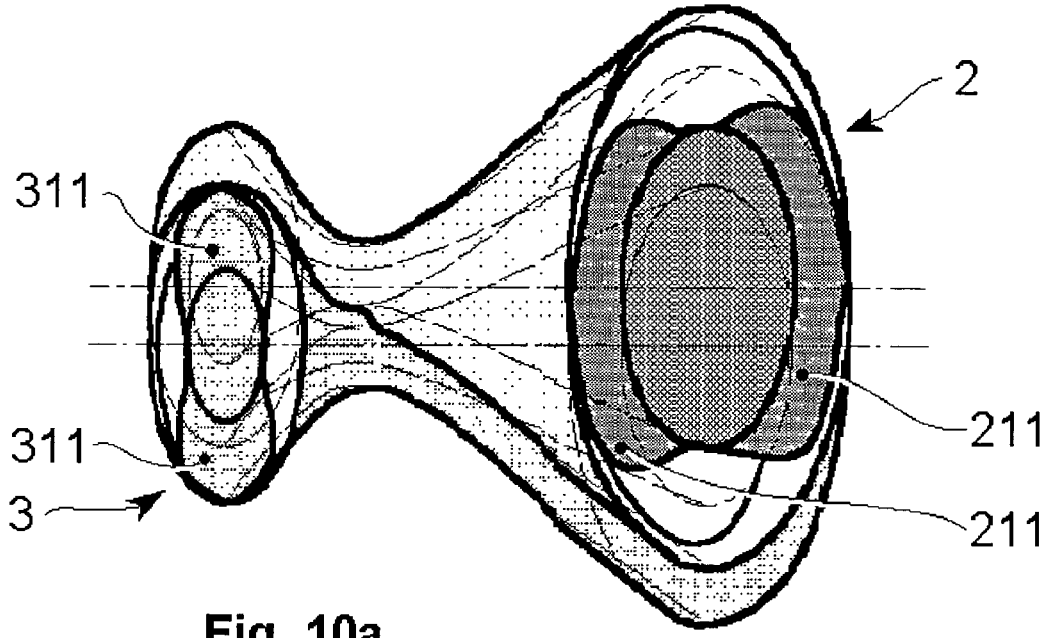
FIG. 10*a* shows rotational wrapper of rotors with spiral teeth wound on shafts with convex surfaces, the rotors having skewed axes, stator is not shown
Figure 10B:
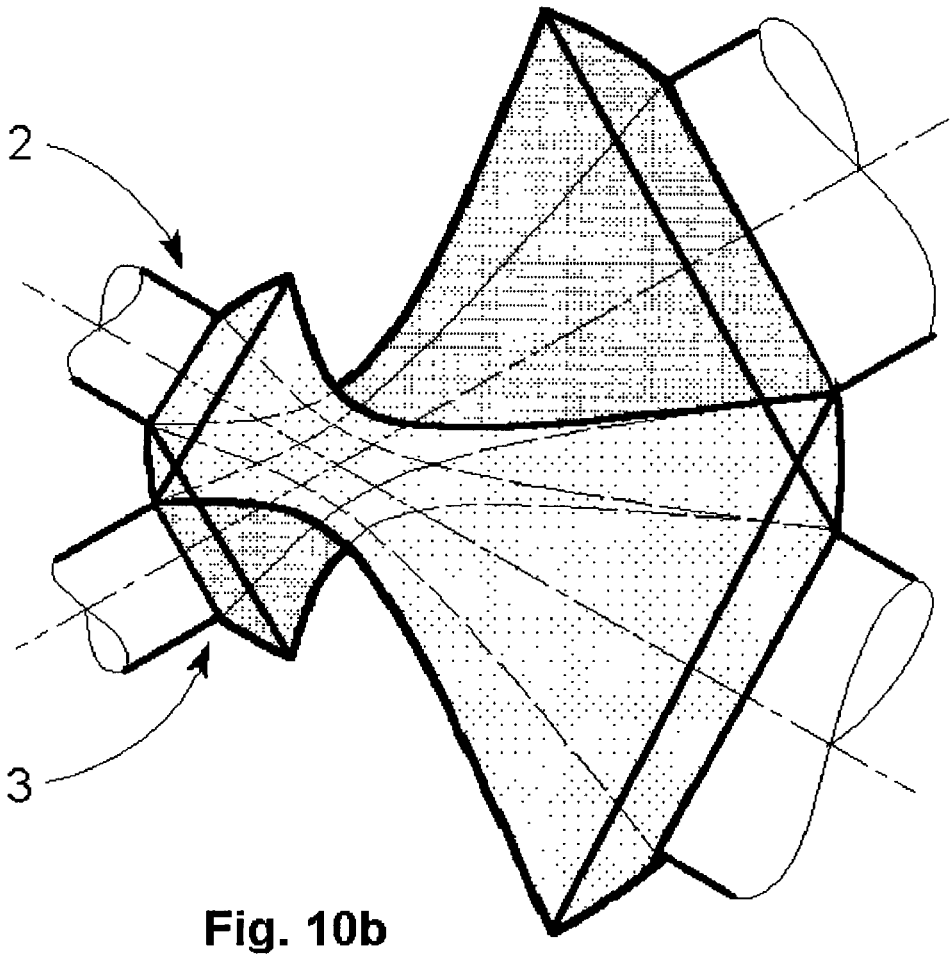
FIG. 10*b* shows rotational wrapper of rotors with spiral teeth wound on shafts with convex surfaces, the rotors having skewed axes, as shown in a plane perpendicular to the view of FIG. 10*a* and parallel to a plane of rotor axes

Further specific embodiment of the equipment according to the invention is schematically presented on FIGS. 10*a*, 10*b*, which for sake of clarity and understandability show only the first rotor 2 and the second rotor 3, without the stator 1. Displayed there are also only rotation wrappers of the first-rotor teeth 211 and the second-rotor teeth 311. This equipment being equivalent to the one shown on FIGS. 8*a*, 8*b*, 8*c* and 8*d*, is also a combustion engine. The only difference is, that the axis of the first rotor 2 and the axis of the second rotor 3 are skew lines. This particular embodiment allows for steep working characteristic of the engine. In alternative cases of skew rotor axis arrangement the equipment could be operated also as a compressor and/or expander, again with the advantage of very steep working characteristics.

Figure 11A:
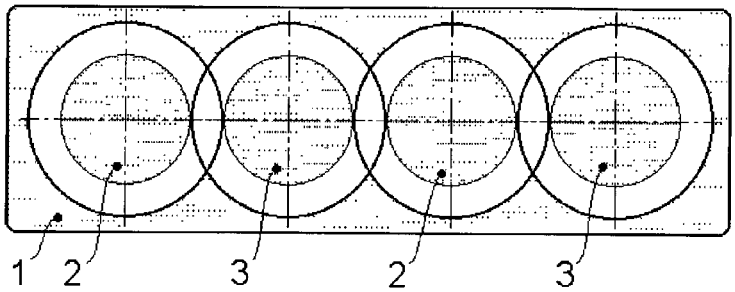
FIG. 11*a* shows a sectional view of a combination of four rotors arranged side by side in a common housing.
Figure 11B:
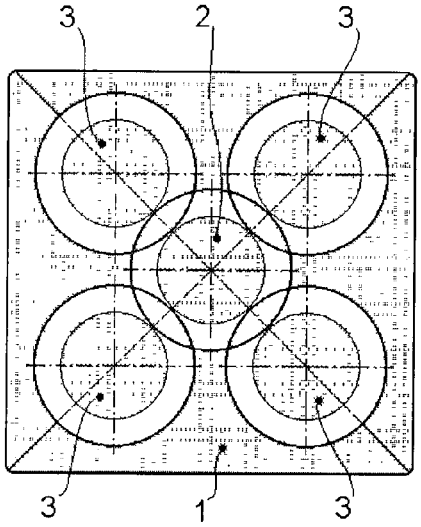
FIG. 11*b* shows a sectional view of a combination of five rotors arranged side by side in a common housing.
Figure 11C:
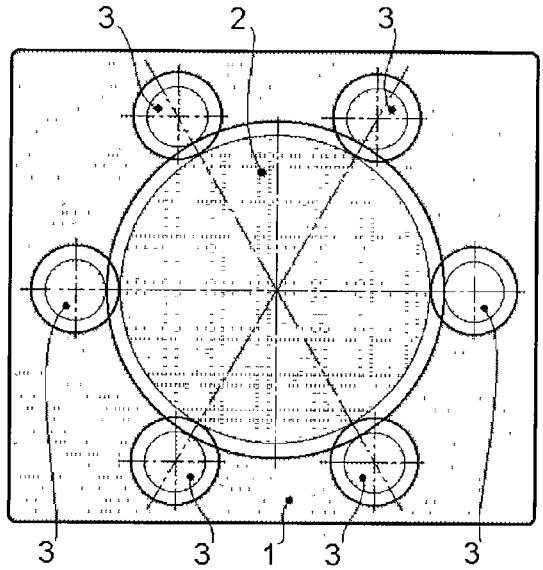
FIG. 11*c* shows a sectional view of a combination of five rotors in a star-shape arrangement in a common housing
Figure 11D:
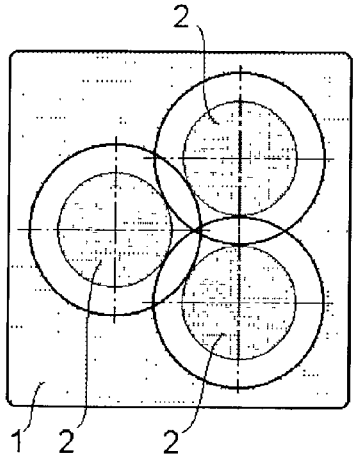
FIG. 11*d* shows a sectional view of a combination of three rotors in a mutual engagement, the rotors being arranged in a common housing.
Figure 11E:
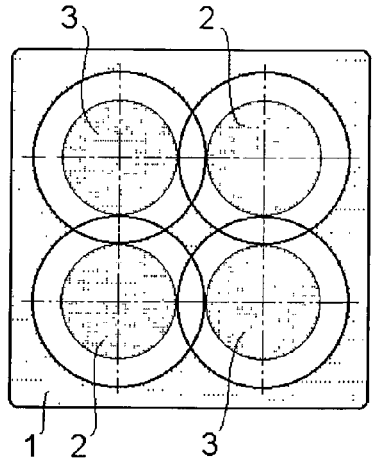
FIG. 11*e* shows a sectional view of a combination of four rotors in a mutual engagement, the rotors being arranged in a common housing

FIGS. 11*a*, 11*b*, 11*c*, 11*d* and 11*e* schematically display several examples of mutual arrangement of the first rotors 2, the second rotors 3 and the stators 1 of the equipment described above. There exists a variety of other combinations, which could be applied according to particular requirements on the equipment functions. FIG. 11*a* presents a side-by-side arrangement of the first rotors 2 and the second rotor 3, their axes being parallel. FIGS. 11*b*, 11*c* show a star-shape arrangement of one first rotor 2 and multiple second rotors 3 seating in the stator 1. FIG. 11*d* illustrates an alternative arrangement of three first rotors 2 in the stator 1, where all three first rotors 2 are in a mutually engagement and therefore must have the same sense of rotation. FIG. 11*e* represents another alternative arrangement of two first rotors 2 and two second rotors 3 in the stator 1, where each rotor engages with two adjacent rotors 2, 3.

Figure 12:
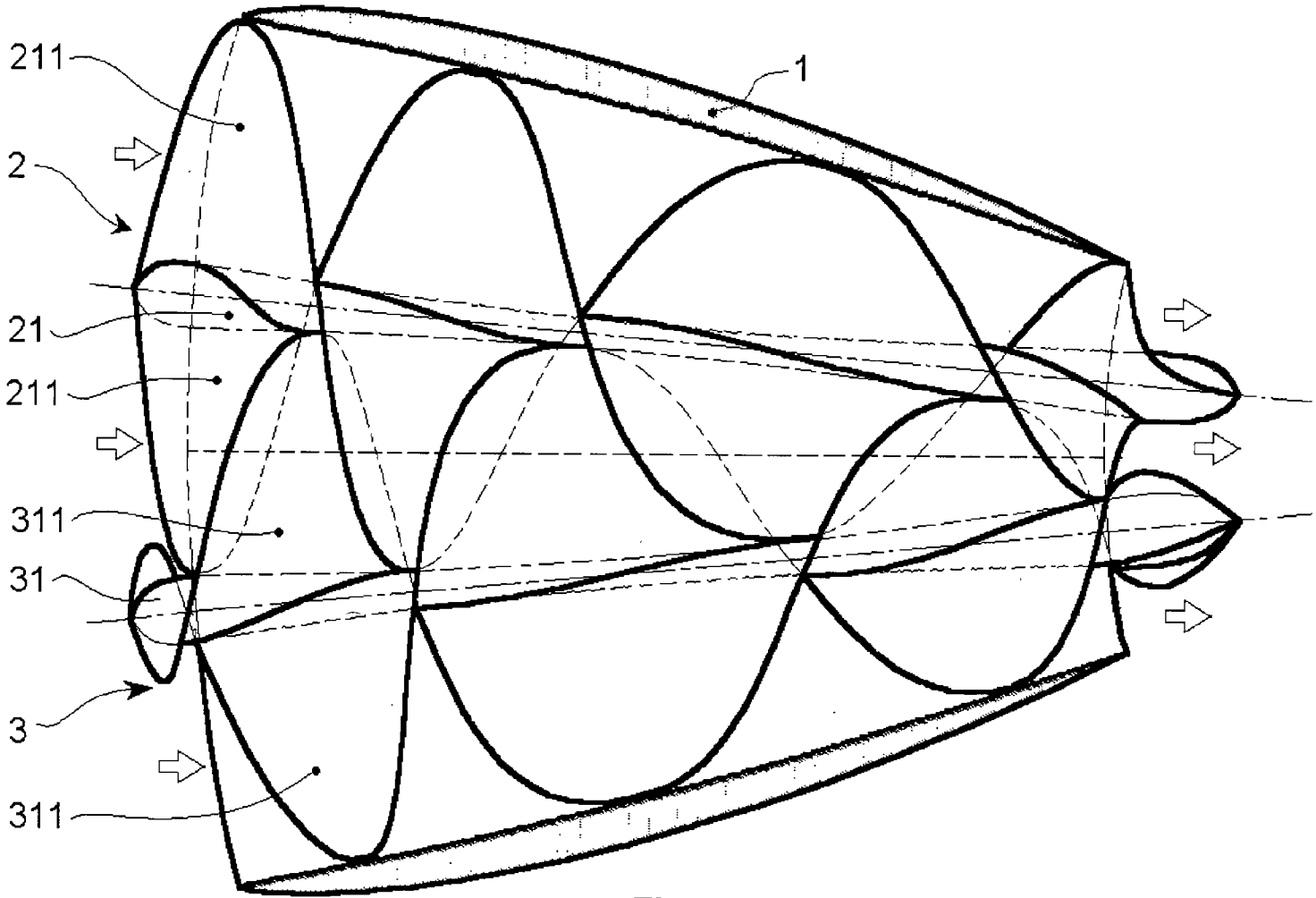
FIG. 12 shows a sectional view of a stator with two spiral rotors each of them provided with spiral teeth wound on shaft surfaces having convex shape, the shafts having concurrent axes. The embodiment is designed for application as a drive for ships.

The last but not least preferred embodiment of the technical solution according to the invention is schematically shown on FIG. 12. In the stator 1, which is also a housing of the equipment, there are seated the first rotor 2 and the second rotor 3. The first rotor 2 consists of the first-rotor shaft 21 with a convex surface, on which there are wound-up the first spiral first-rotor tooth 211 and the spiral second first-rotor tooth 211, both teeth 211 being mutually shifted by the angle of 180°. The second rotor 3 consists of the second-rotor shaft 31 with a convex surface, on which there are wound-up the first spiral second-rotor tooth 311 and the second spiral second-rotor tooth 311, both teeth 311 being mutually shifted by angle of 180°. Both the first rotor 2 and the second rotor 3, have concurrent axis, mutually identical profiles of all first-rotor teeth 211 and second-rotor teeth 311, with lead angle increasing from the inlet side towards the outlet side, provided the volume of thread intermediate spaces is constant. The first-rotor teeth 211, have the opposite sense of lead than the second-rotor teeth 311. Both first-rotor teeth 211 enter into the intermediate spaces of the threads of both second-rotor teeth 311, the rotors engaging substantially along the contact curves. The rotation tracks of the first-rotor teeth 211 and the second-rotor teeth 311 overlap each other. The first-rotor teeth 211 divide the opposite intermediate spaces of the threads of the second-rotor teeth 311 thus substantially closing them as partition walls. At the same time the second-rotor teeth 311 divide the opposite intermediate spaces of the threads of the first-rotor teeth 211 thus substantially closing them as partition walls. The inner space of stator 1 is limited by a rotating wrapper of the first rotor 2 and also by a rotating wrapper of the second rotor 3. In this embodiment the inlet of the equipment on the side with maximum mutual overlapping of the first rotor 2 and the second rotor 3 and the distance between their rotation axis being the largest one. The outlet of the equipment is at the opposite side, with minimum mutual overlapping of the rotors and smallest distance of their rotation axis.

The equipment according to the specific embodiment of FIG. 12 operates in such a way, that by counter rotation of the first rotor 2 and the second rotor 3 within the stator 1 the medium enters through an input into the intermediate space of threads of the first rotor 2 and the second rotor 3 and is moved towards the output. By mutual interaction of the first rotor 2 and the second rotor 3 there is performed a mutual partition of the first rotor 2 thread intermediate space by the second rotor 2 and vice versa. Due to the convex shape of the surfaces of the first-rotor shaft 21 and the second-rotor shaft 31 and increasing angle of lead of both the first-rotor teeth 211 and the second-rotor teeth 311, their thread intermediate spaces are changing in shape but remain constant in volume. Speed of the medium transfer through the thread intermediate space accelerates along the direction from the inlet towards the outlet. Such an embodiment is suitable as a driving gear for ships.

By all the above-mentioned preferred embodiments, except the equipment with only one spiral tooth or only one rotor, it is possible to wind up the spiral teeth alternatively on surface of shafts with a mutual irregular angle shift. It shall require a change of profiles of the spiral teeth, designed by known methods, to achieve mutual interaction between the rotors themselves and the rotors with respect to the stator.

It is also possible to wind up a higher number of spiral teeth on a shaft surface. Nevertheless it shall also require a change of profiles of the spiral teeth, designed by known methods, to achieve mutual interaction between the rotors themselves and the rotors with respect to the stator. It can be advantageous for an effective action of a medium within thread intermediate spaces, for a strength of the material of spiral teeth and for efficiency of the equipment. It is also possible to manufacture variants with different number of spiral teeth wound-up on individual parts of the surface of the same shaft.

Another variety of above-mentioned equipment may comprise embodiments with rotors divided in a plane perpendicular to the axis of their rotation, the rotors being mutually interconnected by gears. The advantage of such variations would include a possibility of a change of working characteristics of particular equipment and a continuous and smooth control of the operation.

From the above mentioned examples of specific embodiments, their alternatives and variations it is evident, that the basic invention idea and the invention step comprise the solution enabling to combine at the same time changes of all parameters of spiral teeth in mutual interaction, concavity and/or convexity of the rotor shaft surfaces and the inner stator surfaces. Each section of the thread intermediate space of the equipment according to the invention could be really different and in any place of the rotor it is possible to change at the same time all three parameters, namely the diameter, the sense of lead and the angle of lead of the spiral teeth.

INDUSTRIAL APPLICATIONS

The present invention is designed for many industrial branches and fields. It can be applied especially everywhere, where compressors and turbo-compressors, expanders, exhausters, combustion engines, steam or gas engines and turbines, hydro-motors, hydro-generators, pump, mixing equipment and spiral drives of ships are used.

The invention claimed is:

1. An equipment with mutually interacting spiral teeth, comprising at least two spiral rotors seating in a stator, where at least a part of a rotation wrapper of each of the rotors and corresponding parts of the stator inner surface and the other rotor shaft surface are created by a rotation of a curve having a convex or concave shape, wherein surfaces of the rotor shafts, a rotation wrapper of each of the rotors, each one being furnished with at least one spiral tooth, and a shape of the stator inner surface are created by a rotation of a combination of curves having at least one of convex and concave shape, the curve waveform being defined by shapes of the spiral teeth profiles and their thread lead, provided the spiral teeth profiles and their thread lead as presented in any section perpendicular to a longitudinal axis of the rotors correspond to required values of pressure, volume and velocity of a media in any part of a working space within the section, the working space being defined as an intermediate space between respective spiral rotors themselves and between the rotors and the stator, while the spiral teeth manifest leads of the same or opposite sense.

2. The equipment according to claim 1, wherein the axis of shafts of the spiral rotors are located in one plane.

3. The equipment according to claim 2, wherein the rotation curve in at least one of its parts comprise a convex curve, while at least in one of the remaining parts it is of a concave type.

4. The equipment according to claim 1, wherein the axis of shafts of the spiral rotors are mutually skewed.

5. The equipment according to claim 4, wherein the rotation curve in at least one of its parts comprise a convex curve, while at least in one of the remaining parts it is of a concave type.

6. The equipment according to claim 1, wherein the rotation curve in at least one of its parts comprise a convex curve, while at least in one of the remaining parts it is of a concave type.

* * * * *